US005521676A

United States Patent [19]

Furushima

[11] Patent Number: 5,521,676

[45] Date of Patent: May 28, 1996

[54] METHOD AND APPARATUS FOR CONTROLLING THE TEMPERATURE OF A FIXING DEVICE IN AN IMAGE FORMING APPARATUS DEPENDING ON A PAPER FEED PATH OR METHOD

[75] Inventor: Tadashi Furushima, Tokyo, Japan

[73] Assignee: Ricoh Company, Ltd., Tokyo, Japan

[21] Appl. No.: 428,362

[22] Filed: Apr. 25, 1995

[30] Foreign Application Priority Data

| | | | |
|---|---|---|---|
| Apr. 28, 1994 | [JP] | Japan | 6-092242 |
| Jan. 30, 1995 | [JP] | Japan | 7-012876 |

[51] Int. Cl.[6] ..... G03G 15/20

[52] U.S. Cl. ..... 355/208; 355/285

[58] Field of Search ..... 355/208, 285; 219/216, 469–71

[56] References Cited

U.S. PATENT DOCUMENTS

| | | | |
|---|---|---|---|
| 4,406,537 | 9/1983 | Mori | 219/216 X |
| 5,073,801 | 12/1991 | Haneda et al. | 355/311 |
| 5,138,392 | 8/1992 | Kinoshita et al. | 355/285 X |
| 5,307,134 | 4/1994 | Nakajima et al. | 355/285 |

FOREIGN PATENT DOCUMENTS

| | | |
|---|---|---|
| 60-22163 | 2/1985 | Japan . |
| 61-135359 | 8/1986 | Japan . |
| 1-99079 | 4/1989 | Japan . |
| 64-88571 | 4/1989 | Japan . |
| 1-173088 | 7/1989 | Japan . |
| 1-300283 | 12/1989 | Japan . |
| 3-69979 | 3/1991 | Japan . |
| 6-161321 | 6/1994 | Japan . |

*Primary Examiner*—Joan H. Pendegrass
*Assistant Examiner*—Quana Grainger
*Attorney, Agent, or Firm*—Oblon, Spivak, McClelland, Maier & Neustadt

[57] ABSTRACT

A method for controlling fixing temperature of a fixing device capable of fixing a toner image on recording paper in an image forming apparatus. A fixing temperature of the fixing device is determined in response to a selected one of plural paper feeders. The fixing temperature is set low, if the paper path of the selected paper feeder is turned path. The fixing temperature is set high, if the selected paper feeder is a FRR paper feeder. Information to determine the fixing temperature in accordance with the selected paper feeder is stored in a memory in a fixing temperature controller, and the temperature is controlled by the controller.

19 Claims, 10 Drawing Sheets

| | STRAIGHT PATH | TURNED PATH |
|---|---|---|
| CORNER NAIL PAPER FEEDER | FIXING TEMPERATURE LOW | FIXING TEMPERATURE LOW |
| FRR PAPER FEEDER | FIXING TEMPERATURE HIGH | FIXING TEMPERATURE LOW |

METHOD AND APPARATUS FOR CONTROLLING THE TEMPERATURE OF A FIXING DEVICE IN AN IMAGE FORMING APPARATUS DEPENDING ON A PAPER FEED PATH OR METHOD

BACKGROUND OF THE INVENTION

1. Field of the Invention

The present invention relates to an image fixing device for fixing a toner image on recording paper,the fixing device adapted for use in an image forming apparatus such as a copier, a printer, a facsimile transceiver or similar photographic image forming apparatus. More particularly, the invention is concerned with a fixing temperature control device for controlling the fixing temperature to obtain a good fixing condition.

2. Description of the Related Art

In the image forming apparatus which has a plurality of paper feed devices, the distances from the respective paper feed devices to the fixing device differ. Japanese Patent Laid-Open Publication No. 64-40955 discloses an image fixing device in which a reload temperature which can start the paper feed and is lower than the fixing temperature is varied for each paper feed device in consideration of time for feeding the paper from the paper feed device to the fixing device. In this prior art, the reload temperature is set according to the distance from the paper feed device to the fixing device. The temperature between fixing operation at the fixing device is maintained lower when the paper feed distance is longer. As a result the time from operation of a print key until printing is completed is longer and power consumption is reduced.

As another prior art, Japanese Laid-Open publication No. 60-169876 discloses a fixing device for an image forming apparatus in which the fixing temperature is varied according to the thickness of the paper. The apparatus has two modes, one is a cassette mode in which the paper is fed from a paper feed cassette, and the other is a manual mode in which it is fed from a manual paper feed tray. The fixing temperature of the manual mode is higher than that of the cassette mode, taking into consideration the various kinds of paper which are fed from the manual paper feed tray. The fixing temperature in the manual mode, however, is uniformly higher than that in the cassette mode. Therefore, the fixing temperature is low, even if a paper feed path and a paper feed form in the cassette mode are suitable for thick paper and the paper is set in the cassette. As a result, a fixing ability is bad, so that the toner image on the recording paper is bad in quality.

SUMMARY OF THE INVENTION

Accordingly, an object of the present invention is to provide an image fixing device for an image forming apparatus which can solve the aforementioned conventional drawbacks, and which can improve the quality of the toner image on the recording paper.

It is another object of the present invention to provide an image fixing device which can reduce energy consumed in fixing.

It is a further object of the present invention to provide an image fixing device which can improve the efficiency of the copying operation with reduced printing time.

These and other objects are achieved according to the present invention by providing a fixing temperature control method for an image forming apparatus which has a plurality of paper feed devices, including outputting information on a selected paper feed device among the plurality of paper feed devices, and controlling the fixing temperature in response to information on a paper feed path from the selected paper feed device to a fixing device and information on a form of paper feed of said selected paper device.

BRIEF DESCRIPTION OF THE DRAWINGS

The above and other objects, features and advantages of the present invention will become apparent from the following detailed description, particularly when considered in conjunction with the accompanying drawings in which.

DESCRIPTION OF THE PREFERRED EMBODIMENTS

Figure 1:
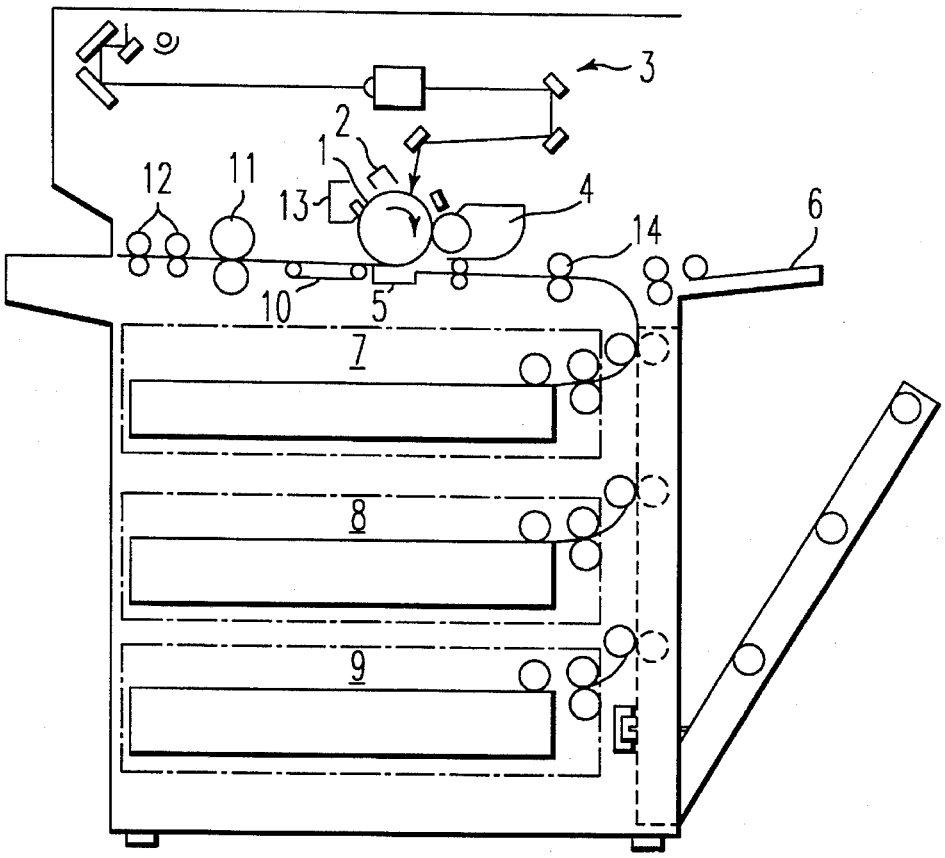
FIG. 1 is a schematic sectional view of one embodiment of a copier in accordance with the present invention.

Referring now to the drawings, wherein like reference numerals designate identical or corresponding parts throughout the several views, and more particularly to FIG. 1 thereof, the copier includes a photosensitive drum 1 which is supported by a housing of the copier. The photosensitive drum 1 is driven to rotate in the direction indicated by an arrow at constant speed.

A surface of the photosensitive drum 1 is uniformly charged by a charging device 2. The charged surface of the photosensitive drum 1 is exposed by an exposing means 3, then an electrostatic latent image is formed on the surface of the photosensitive drum 1. The electrostatic latent image is developed by a developing device 4, the developing image is transferred to recording paper which is transported from any of paper feed devices 6, 7, 8, or 9. Paper feed devices 6, 7, 8, and 9 adopt the Feed and Reverse Roller paper feeder (FRR paper feeder). After transferring the image, the recording paper is separated from the photosensitive drum 1, and transported to a fixing device 11 by a transport belt 10. The toner image on the recording paper is fixed by the fixing device 11, and the paper is discharged to a paper tray by discharging rollers 12. The residual toner on the photosensitive drum 1 is cleaned by a cleaning device 13 after the surface of the photosensitive drum 1 is discharged.

The fixing device 11 includes a fixing roller in which a heater is installed, and a pressure roller.

The reload temperature and the fixing temperature during feeding from paper feed device 6 are set high, and are set low during feeding from devices 7, 8, and 9, since the reload temperature should be set in accordance with a distance of the paper feed path from the paper feed device to the fixing device. In the present invention, the reload temperature is a temperature at the fixing device below which the operation of the start key will not start a printing operation. In other words, the reload temperature is the standby temperature at which the fixing device is maintained between copying operations. If the reload temperature is below a certain minimum level, depending on the distance of the paper feeding path and the paper thickness, operation of the start key will not be effective to start a copying operation until the reload temperature is raised to the minimum level. Once the minimum level, i.e., the reload temperature, is attained, copying can be commenced, with the temperature at the fixing device then being raised to the fixing temperature so that by the time that a developed paper sheet is presented for fixing to the fixing device, the temperature at the fixing device has been raised from the reload temperature to the fixing temperature.

Figure 2:
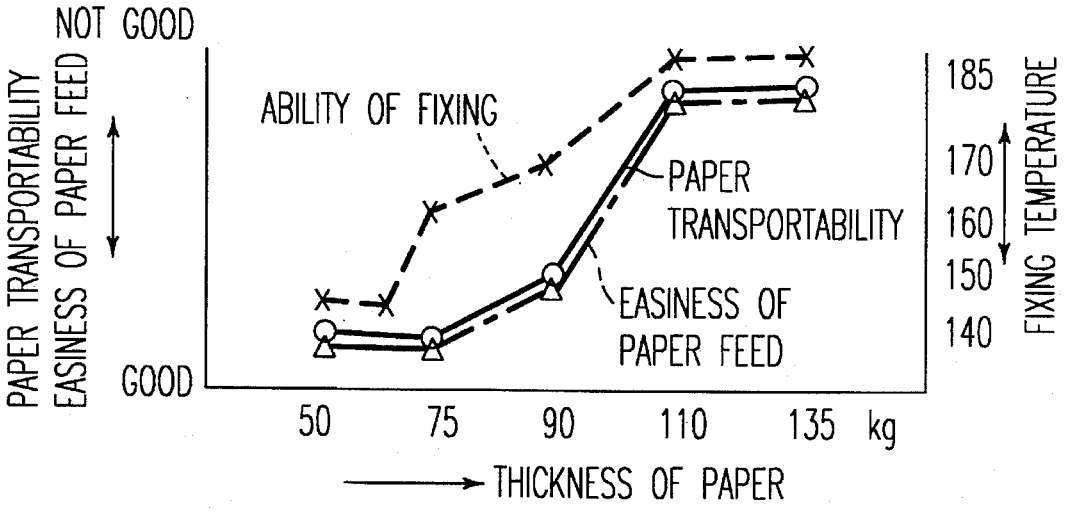
FIG. 2 is a graph representing a relation between a paper thickness and easiness of the paper feed, a paper transportability, and ability of fixing a toner image on recording paper in accordance with the present invention.

The reason for the different fixing temperatures is explained as follows:

FIG. 2 showing a relation between a paper thickness and ease of the paper feed, paper transportability, and ability of fixing a toner image on a recording paper. Referring to FIG. 2, if the paper sheet is thick, ease of paper feed and paper transportability are poor, and the fixing temperature is high.

As for the paper transportability, the paper feed path of the paper feed devices 7, 8, and 9 has a turn. In such a case, thick paper such as the paper of 135 kg is difficult to be transported. Therefore the thick paper is usually transported through a straight pass. In other words, the paper feed devices 7, 8, and 9 take only the thin paper. Meanwhile, the paper feed device 6 takes both thin paper and thick paper, since it has the straight pass.

As for the ease of paper feed, there are many known kinds of forms of paper feed, such as the Feed and Reverse Roller paper feed form (FRR paper feed form) and the corner nail paper feed form, explained below.

The paper feed device using the FRR paper feed form takes both thin paper and thick paper. Meanwhile, the corner nail paper feed form can feed thin paper such as the paper from 45 kg to 90 kg, but is not able to feed thick paper such as paper from 110 kg to 135 kg, since the corner nail paper feeder separates the paper from a paper cassette using elasticity of the paper which is generated by bending paper. Therefore, a paper feed device using the corner nail paper feeder usually stores only the thin paper, while a paper feed device using the FRR paper feeder usually takes both the thin paper and the thick paper. As shown in FIG. 2, in proportion to the thickness of the paper, the fixing temperature is high, so that the relationship between the fixing temperature and the paper transport path, and the relationship between the fixing temperature and the form of paper feed are as shown in FIG. 3.

Figures 3, 4:
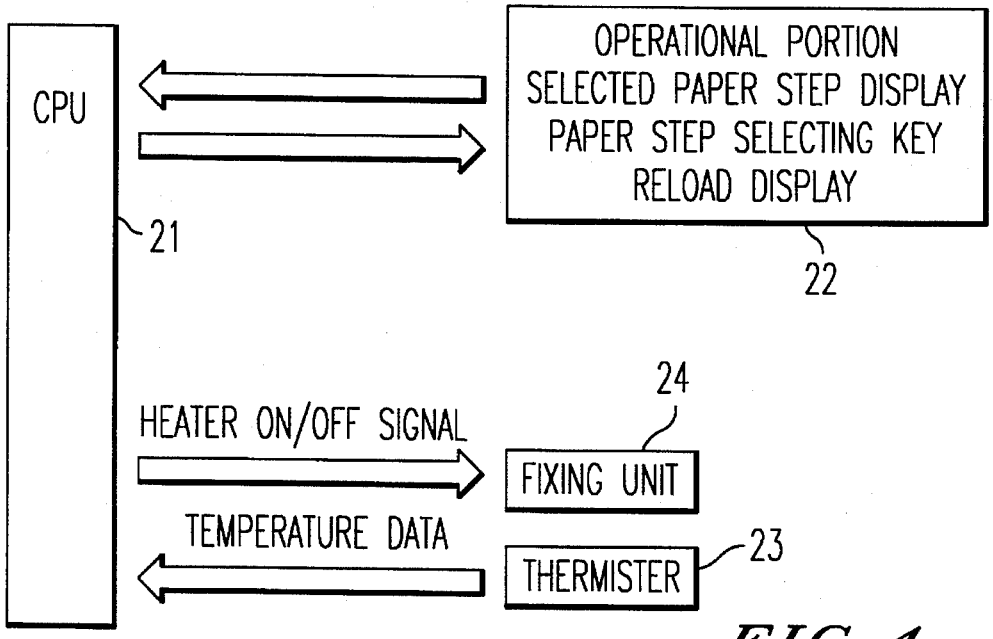
FIG. 3 is a table representing a fixing temperature conducted to determine a relation between a paper feed path and a form of paper feed.
FIG. 4 is a schematic block diagram of fixing control device in accordance with the present invention.

Referring to FIG. 3, in case the form of paper feed is the corner nail paper feeder and the paper transport path is a straight path, the fixing temperature is set low, since thin paper will be stored. In case the form of paper feed is a corner nail paper feeder and the paper transport path is a turned path, the fixing temperature is set low. In case the form of paper feed is the FRR paper feeder and the paper transport path is a straight path, the fixing temperature is set high. In case the form of paper feed is the FRR paper feeder and the paper transport path is a turned path, the fixing temperature is set low. Therefore, as for the image forming apparatus of FIG. 1, the first paper feed device 6 has a FRR paper feeder and a straight paper path, so that the fixing temperature associated with the paper feed device 6 is set high. As for paper fed from the paper feed devices 7, 8 and 9, a form of paper feed is the FRR paper feeder and the paper transport path is a turned path, so that the associated fixing temperature is set low.

The fixing temperature and the reload temperature associated with the different paper feed device are stored in a memory of a central processing unit 21 shown in FIG. 4.

FIG. 4, illustrates a controller including the central processing unit which processes a signal from an operational portion 22, and outputs signals to the operational portion 22. Furthermore, the central processing unit 21 receives data of the temperature of the fixing roller from a thermistor 23 and outputs an ON/OFF signal to a fixing unit 24 so as to control the temperature of the fixing roller.

The central processing unit 21 also receives a paper feeder selection signal from a paper feeder selection key of the operational portion 22, selects the fixing temperature and the reload temperature in correspondence with the selected paper feeder, and then outputs information of the selected temperature to the fixing unit 24. The central processing unit 21 controls the ON/OFF signal to maintain the fixing temperature according to such information and data indicative of the temperature of the fixing roller.

When the reload temperature reaches a predetermined temperature, the information of the reload temperature is supplied to the operational portion 22, and the operational portion 22 then indicates that operation of the print start key is acceptable.

Figure 5:
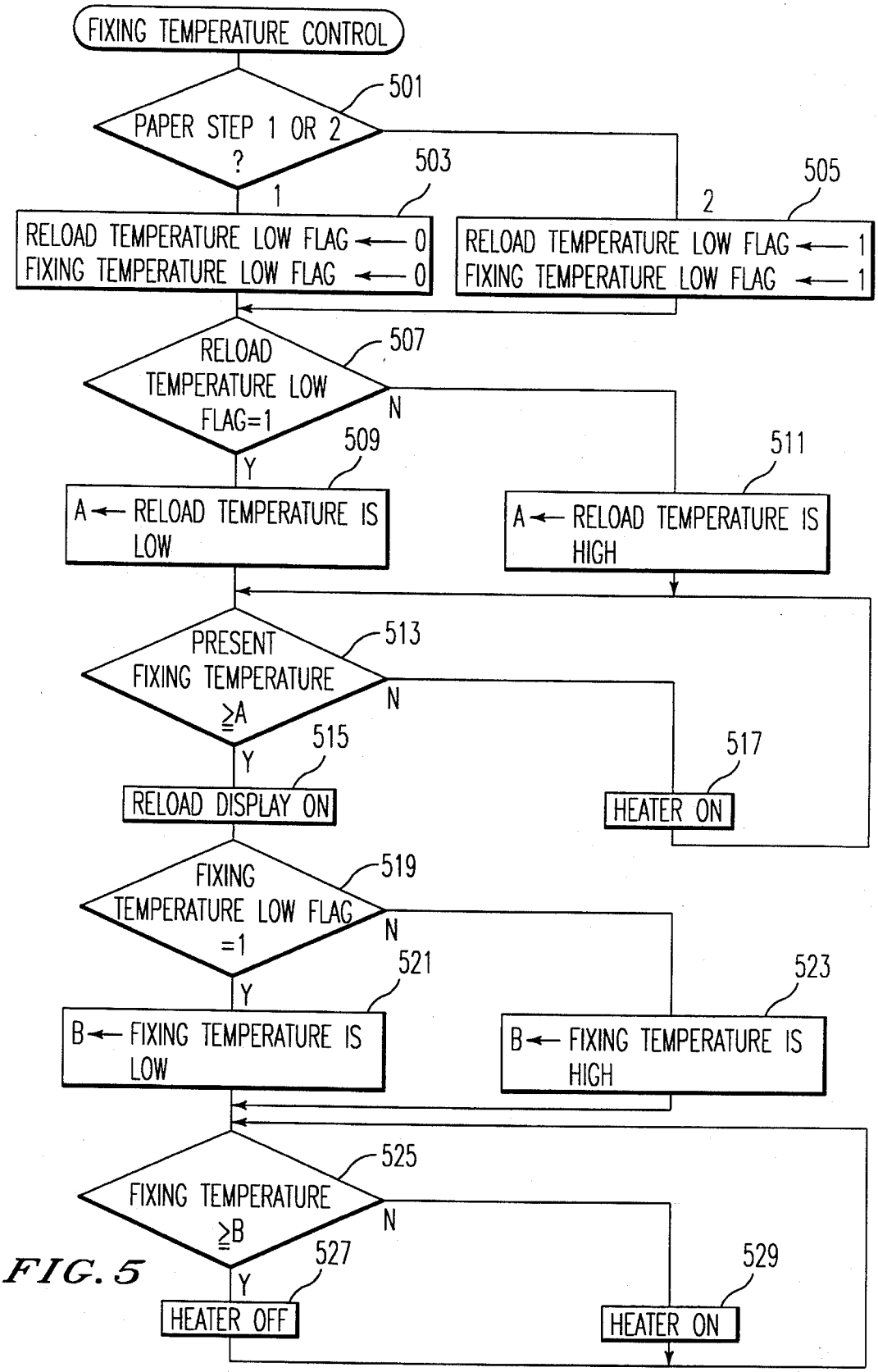
FIG. 5 is a flow chart showing a fixing temperature control method of a fixing device provided in the apparatus of FIG. 1.

FIG. 5 shows a flowchart to determine the reload temperature and the fixing temperature of the image forming apparatus of FIG. 1. The process shown in FIG. 5 is done in the controller shown in FIG. 4.

Referring to FIG. 5, after a source of electric power is turned on, in step 501 it is checked whether paper feed step 1 or 2 is selected, step 1 being a paper feed from device 6 and step 2 being a paper feed from one of paper feed devices 7, 8 or 9. If a selection signal of the first paper feed step is outputted from the operational portion 22 in step 501, in step 503 the central processing unit 21 resets a reload temperature low flag and a fixing temperature low flag. The central processing unit then recognizes the reload temperature and the fixing temperature as being set high. If in step 501 the selection signal of the second paper feed step is outputted, in step 505 the central processing unit 21 sets the reload temperature low flag and the fixing temperature low flag. The central processing unit 21 then recognizes the reload temperature and the fixing temperature as being set low. If in step 507 it is determined that the reload temperature low flag is set, low reload temperature data, for example temperature data corresponding to 145° C., are set in a register A of the central processing unit 21 in step 509. If in step 507 the reload temperature low flag is reset, in step 511 high reload temperature data, for example data corresponding to a temperature is 165° C., are set in the register A of the central processing unit. The content of the register A, which represents the reload temperature, is compared with the measured temperature of the fixing roller in step 513. If the measured temperature of the fixing roller is higher than the reload temperature, that is, the temperature of the fixing roller has reached the reload temperature, in step 515 the central processing unit 21 outputs the reload signal to the operational portion 22, and as a result a print key on the operational portion 22 is effective to commence printing. If in step 519 the fixing temperature low flag is set, in step 521 low fixing temperature data, for example corresponding to a temperature of 175° C., are set in the register B of the central processing unit. If in step 519 the fixing temperature low flag is reset, in step 523 high fixing temperature data, for example corresponding to 185° C., are set in the register B. If the temperature of the fixing roller has not reached the reload temperature in step 513, the heater of the fixing roller is turned on in step 517. Then, the temperature of the fixing roller is again compared to the reload temperature in step 513.

In step 525, the temperature of the fixing roller is compared to the fixing temperature stored in register B. If the temperature of the fixing roller is higher than the stored fixing temperature, the heater is turned off in step 527. Meanwhile, if the temperature of the fixing roller is lower than the stored fixing temperature, the heater is turned on in step 529.

Figure 6:
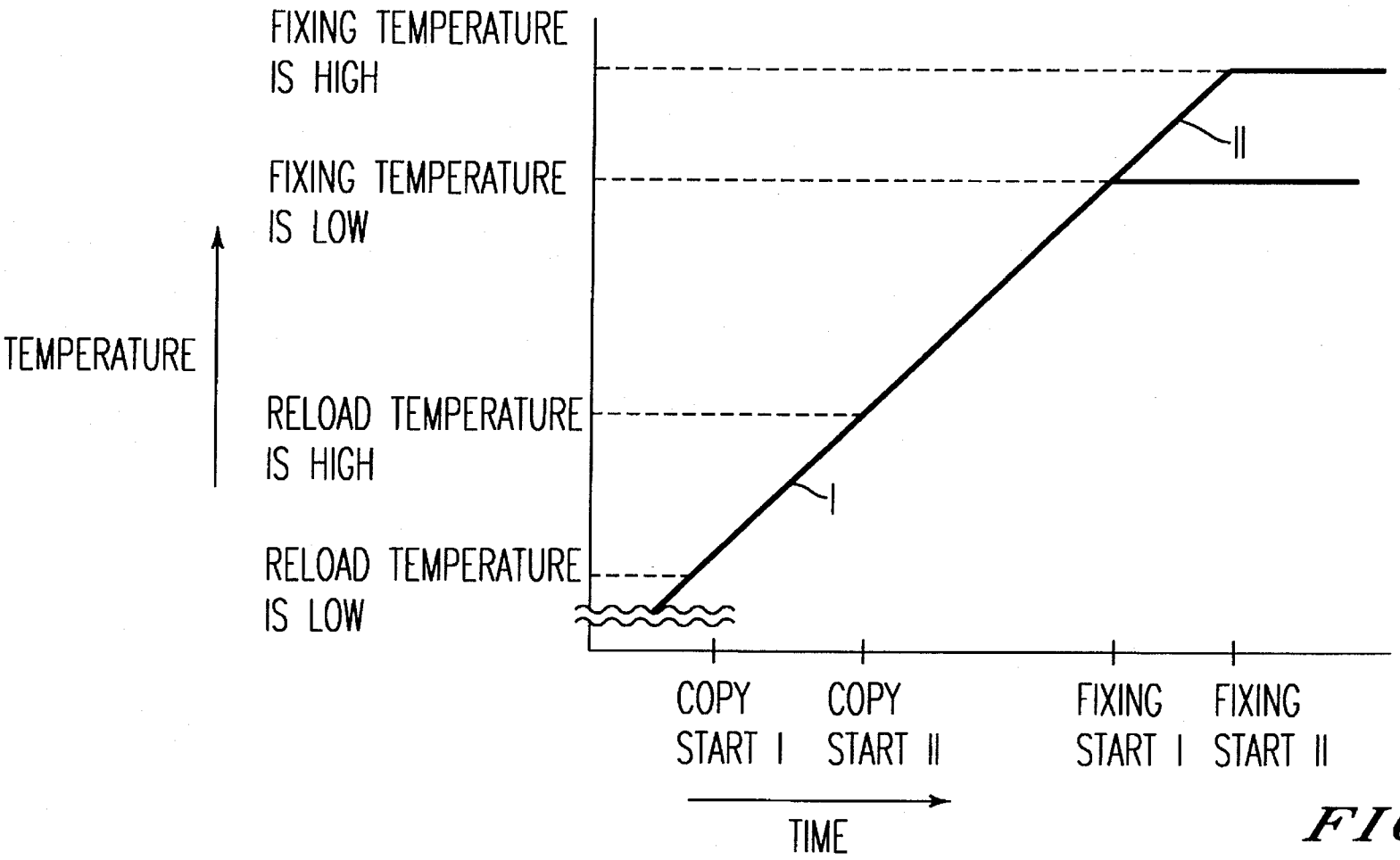
FIG. 6 is a graph representing a reload temperature and a fixing temperature.

Referring to FIG. 6, a change in temperature in case of the low fixing temperature is indicated as the line I. The reload temperature and the fixing temperature are set low. Meanwhile, a change in temperature of the high fixing temperature is indicated as the line II. The reload temperature and the fixing temperature are set high.

Figure 7:
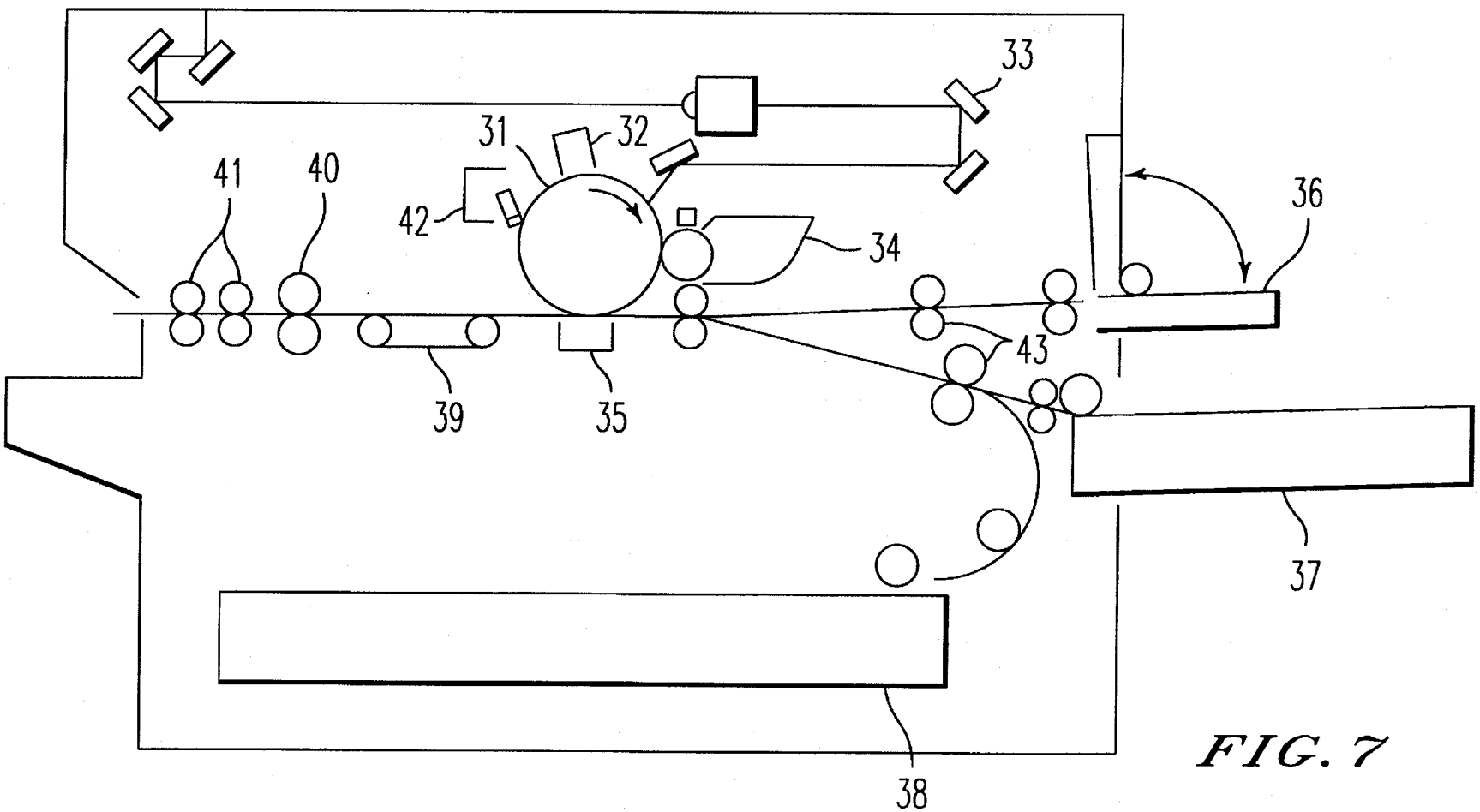
FIG. 7 is a schematic sectional view of a second embodiment of a copier embodying a fixing device in accordance with the present invention.

FIG. 7 is a schematic sectional view of the second embodiment of a copier in accordance with the present invention. Referring to FIG. 7, the copier includes a photosensitive drum 31 which is supported by a housing of the copier. The photosensitive drum 31 is driven to rotate in the direction indicated by an arrow at constant speed.

A surface of the photosensitive drum 31 is uniformly charged by a charging device 32. The charged surface of the photosensitive drum 31 is exposed by an exposing device 33, whereby an electrostatic latent image is formed on the surface of the photosensitive drum 31. The electrostatic latent image is developed by a developing device 34, and the developed image is transferred to a recording paper which is transported from one of paper feed devices 36, 37 or 38. After transferring the image, the recording paper is separated from the photosensitive drum 31, and transported to a fixing device 40 by a transport belt 39. The toner image on the recording paper is fixed by the fixing device 40, and the paper is discharged by discharging rollers 41 to a paper tray (not shown). The residual toner on the photosensitive drum 31 is cleaned by a cleaning device 42 after the surface of the photosensitive drum 31 is discharged by a discharging device (not shown). In this embodiment, the paper feed device 36 is a manual paper feeder and a FRR paper feeder. The paper feed device 37 uses the paper feed cassette and is the FRR paper feeder. The paper feed device 38 is a front loading paper feeder and the corner nail paper feeder.

The image forming apparatus of this embodiment has a controller shown in FIG. 4. The reload temperature and the fixing temperature of each paper feed device are stored in the central processing unit 21. Therefore, as for the paper feed devices 36 and 37 of the image forming apparatus of FIG. 7, the paper feeder is the FRR paper feeder, and the paper transport path is the straight paper path, so that both the thick and the thin paper are stored, and the fixing temperature is set high. As for the paper feed device 38, the paper feeder is the FRR paper feeder, and the paper transport path is the turned path, so that the thin paper is usually stored and the fixing temperature is set low. The reload temperature of the paper feed devices 36 and 37 is set high, and that of the paper feed device 38 is set low.

Figure 8:
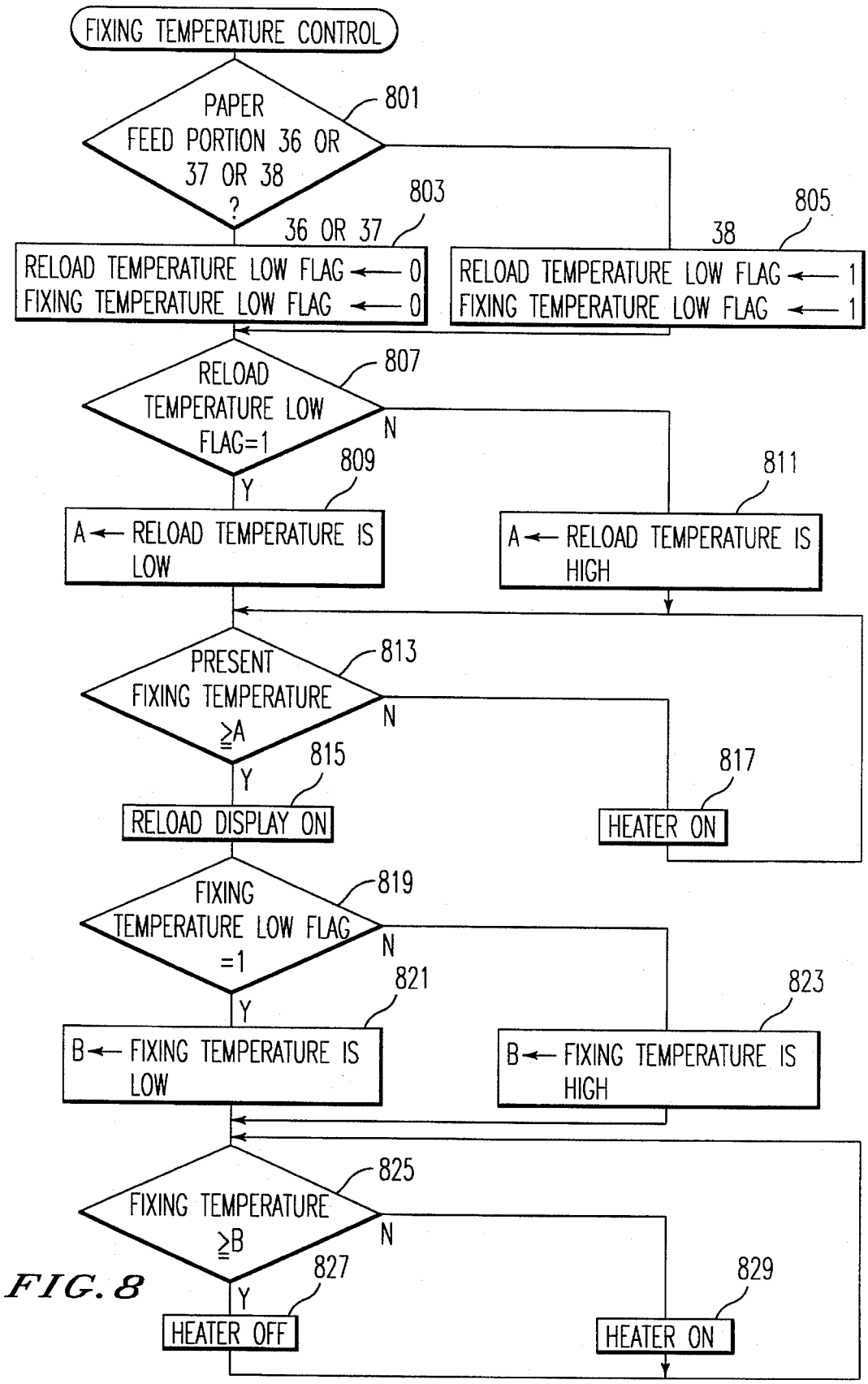
FIG. 8 is a flow chart showing a fixing temperature control method of a fixing device of the copier of FIG. 7.

FIG. 8 shows a flowchart to determine the reload temperature and the fixing temperature of the image forming apparatus of FIG. 7. The process shown in FIG. 8 is executed in the controller shown in FIG. 4.

Referring to FIG. 8, after a source of electric power is turned on, in step 801 it is checked which of the paper feed devices is selected. If a selection signal indicative of selection of one of the paper feed devices 36 or 37 is outputted from the operational portion 22, in step 803 the central processing unit 21 resets the reload temperature low flag and the fixing temperature low flag. The central processing unit recognizes the reload temperature and the fixing temperature as being set high. If the selection signal of the paper feed portion 38 is outputted, in step 805 the central processing unit 21 sets the reload temperature low flag and the fixing temperature low flag. Thereafter, steps 807, 809, 811, 813, 815, 817, 819, 821, 823, 825 and 829 respectively corresponding to steps 507, 509, 511, 513, 515, 517, 519, 521, 523, 525 and 529 are performed. The detailed description is therefore omitted.

As for the selection of the paper feed device 36 at step 801, it is possible that if the movement of the manual paper feed tray 36 from the dotted line to the solid line of FIG. 7 is detected, a selection signal indicative of selection of the paper feed device 36 is outputted.

As for the embodiment of FIG. 1, the fixing temperature of the paper feed devices 7, 8 and 9 is set low, because the paper feed path of each of these paper feed devices is turned and the thin paper is stored in the paper feed portion. The fixing temperature, however, may change according to a size of an arc. That is, the paper feed device 7 stores only the thin paper because the size of the arc of the paper feed path is large. Meanwhile, the paper feed devices 8 and 9 stores both the thin paper and the thick paper, because the size of the arc of the paper feed path is small and the form of paper feed is the FRR paper feeder. The process to determine the fixing temperature in this case is shown in FIG. 9.

Figure 9A:
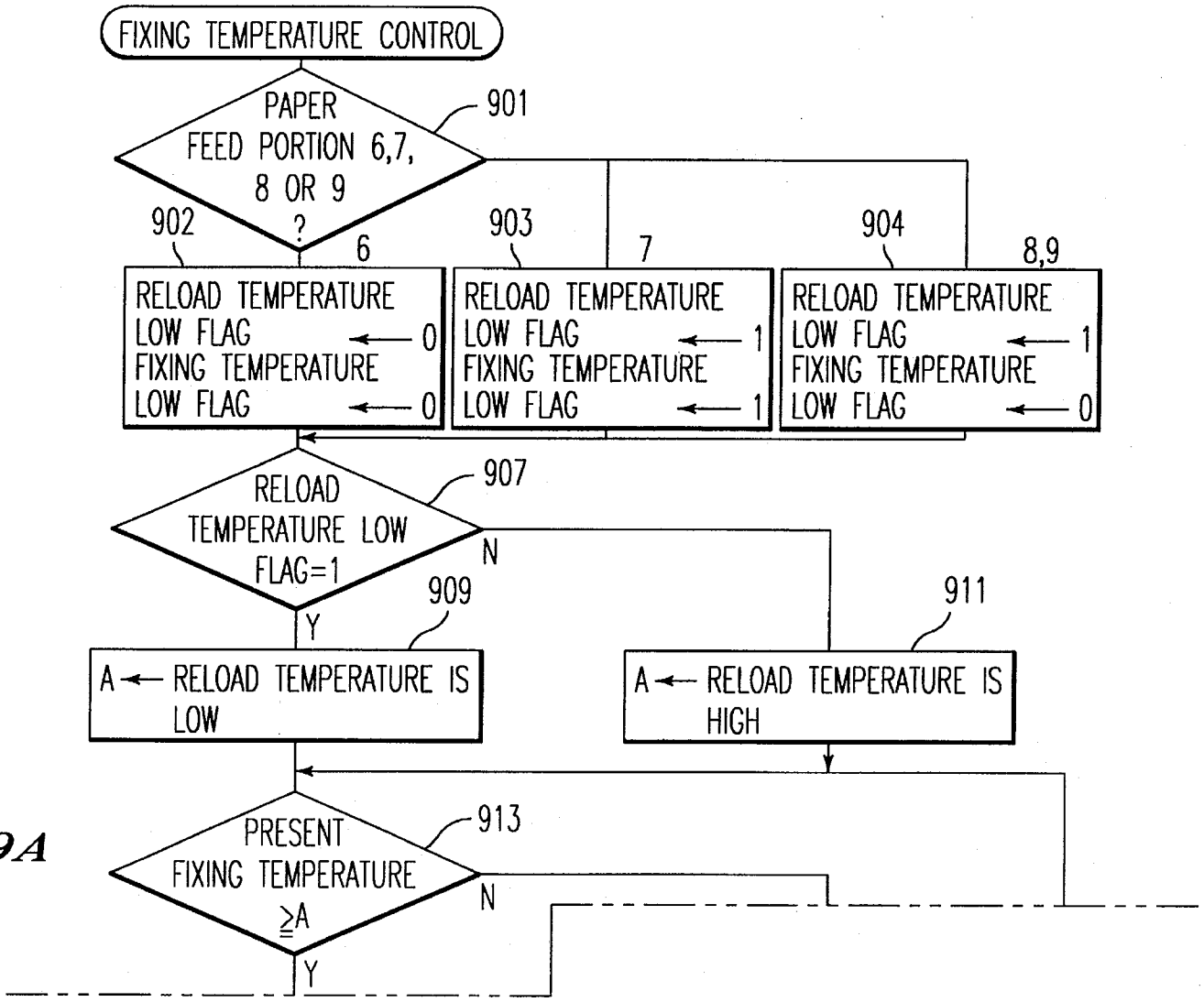
FIG. 9 is a flow chart showing a modified fixing temperature control method of a fixing device of FIG. 1.
Figure 9B:
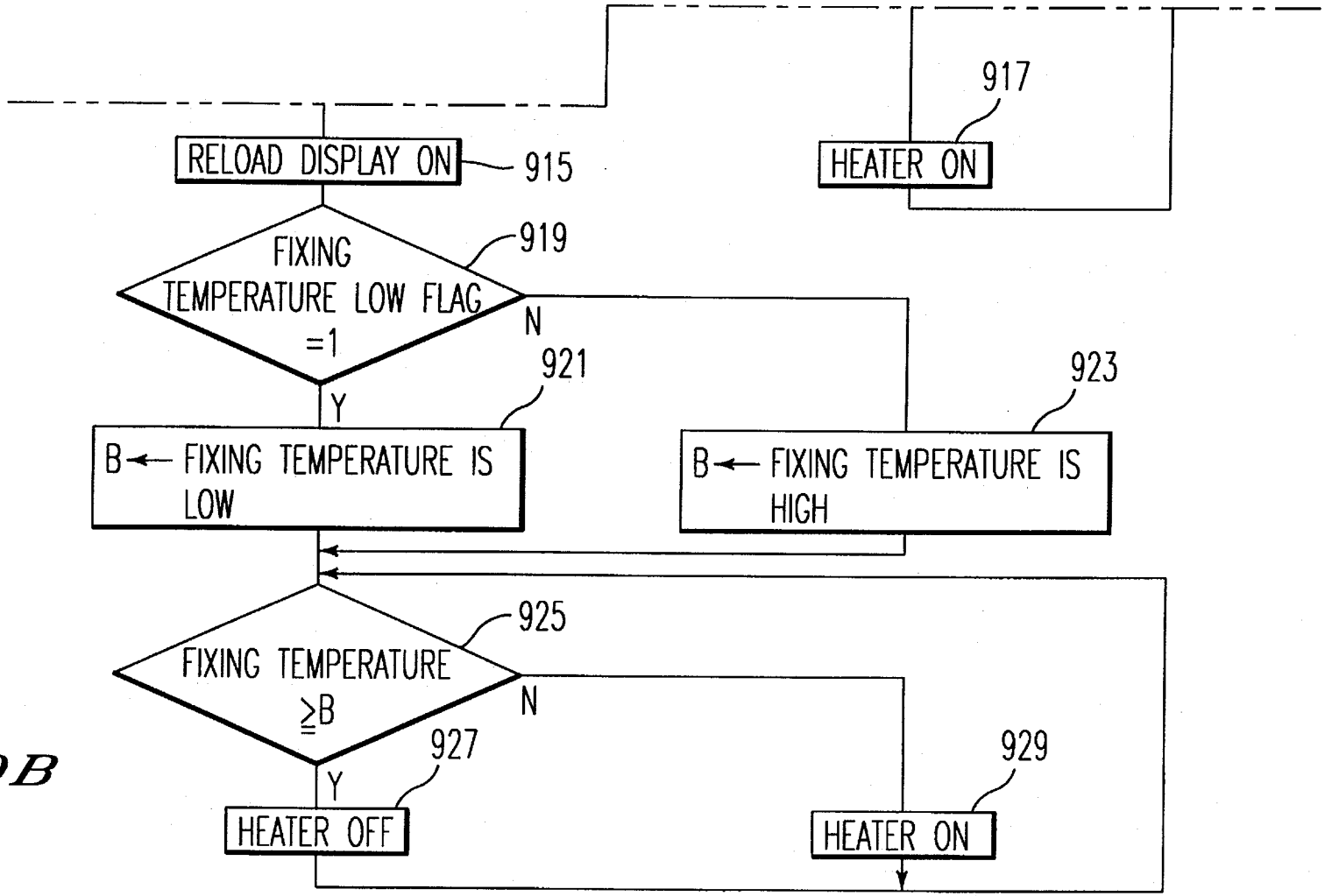

Referring to FIG. 1 and FIG. 9, after a source of electric power is turned on, which of the paper feed devices 6, 7, 8 or 9 is selected is checked in step 901. If the paper feed device 6 is selected as determined from a selection signal outputted from the operational portion 22, the central processing unit 21 resets the reload temperature low flag and the fixing temperature low flag in step 902. If the selection signal indicates selection of the paper feed device 7, the central processing unit 21 sets the reload temperature low flag and the fixing temperature low flag in step 903. If a selection signal indicates selection of the paper feed devices 8 or 9, the central processing unit 21 sets the reload temperature low flag and resets the fixing temperature low flag in step 904. Thereafter, steps 907, 909, 911, 913, 915, 917, 919 921, 923,925, 927 and 929 respectively corresponding to steps 507, 509, 511, 513, 515, 517, 519, 521, 523, 525, 527 and 529 are performed and the detailed description of which is therefore omitted.

Figure 10A:
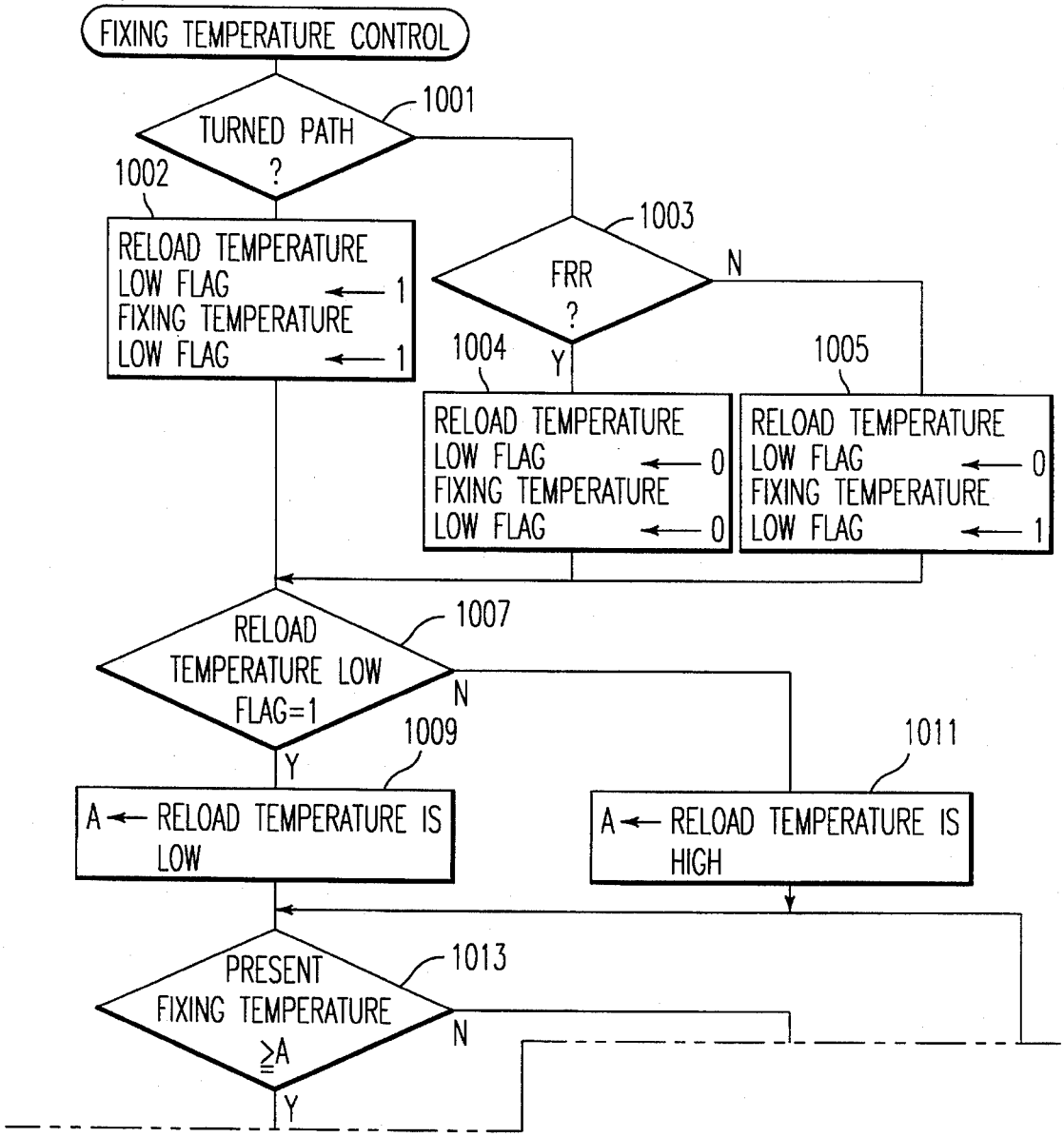
FIG. 10 is a flow chart showing a modified fixing temperature control method of a fixing device.
Figure 10B:
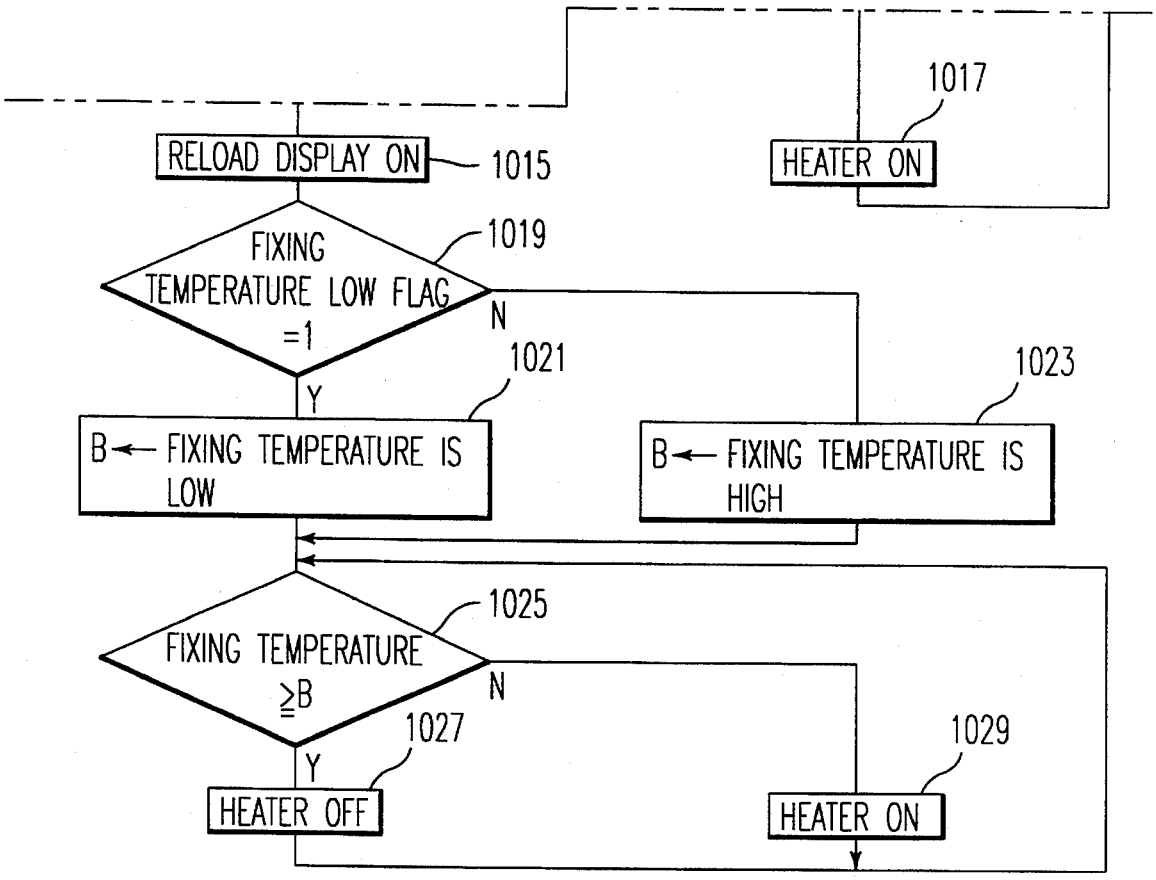

FIG. 10 shows the third embodiment of this invention. In this embodiment, a form of paper feed and the paper feed path of each paper feed device, and the fixing temperature as shown in FIG. 3 are stored in the central processing unit 21 of FIG. 4.

Referring to FIG. 10, after a source of electric power is turned on and the paper feed portion is selected, in step 1001 it is judged whether or not the paper feed path of the selected paper feed device is a turned path. If the selected paper feed path is turned, in step 1002 the reload temperature low flag is reset because the distance from the paper feed portion to the fixing portion is long, and the fixing temperature low flag is set. If the selected paper feed path is not turned, that it is a straight path, in step 1003 it is judged whether or not the selected paper feeder is the FRR paper feeder. If the selected paper feeder is the FRR paper feeder, the reload temperature low flag and the fixing temperature low flag is reset in step 1004. If the selected paper feeder is not the FRR paper feeder, that is, it is the corner nail paper feeder, the reload temperature low flag is reset, and the fixing temperature low flag is set in step 1005. Thereafter, steps 1007, 1009, 1011, 1013, 1015, 1017, 1019, 1021, 1023, 1025, 1027 and 1029 respectively corresponding to steps 507, 509, 511, 513, 515; 517, 519, 521, 523, 525, 527 and 529 are performed. The detailed description is therefore omitted.

In this embodiment, if the paper feed path of the paper feed devices 8 and 9 of FIG. 1 can feed the thick paper, the paper feed path of the paper feed devices 8 and 9 are stored as the straight path in the central processing unit 21. The stored contents associated with the paper feed path may be set by a serviceman based on environmental considerations (e.g., temperature and humidity) where the image forming apparatus is set.

As for the modified embodiment of FIG. 10, the paper feed device may be automatically determined according to a document size and a magnification instead of the manual selection. In this case, if the same size of paper is stored in the plural paper feed devices, the fixing temperature for each paper feed device is compared by the central processing unit 21. As a result of the comparison, paper is fed from the paper feed device in which the fixing temperature is the lowest.

Obviously, numerous modification and variations of the present invention are possible in light of the above teachings. It is therefore to be understood that within the scope of the appended claims, the invention may be practiced otherwise than as specifically described herein.

What is claimed is as new and is desired to be secured by Letters Patent of the United States is:

1. A fixing temperature control method for controlling a fixing temperature of a fixing device in an image forming apparatus which has a plurality of paper feed devices which have different paper feed paths, comprising the steps of:

determining a paper path which is to be used by the image forming apparatus; and controlling a fixing operation temperature of the fixing device based on a size of an arc of the paper path which is to be used.

2. A method according to claim 1, further comprising the step of:

determining different fixing operation temperatures of the fixing device which are to be used by the controlling step based on different sizes of arcs of the paper feed paths of the image forming apparatus is to be used.

3. A method according to claim 1, wherein the controlling step selects the fixing operation temperature from a plurality of temperatures which are used with a plurality of paper paths, at least two of which have different size non-zero arcs.

4. A method according to claim 1, further comprising the steps of:

determining a paper feed method which is to be used by the image forming device;

wherein the controlling step further includes controlling the fixing operation temperature of the fixing device based on the paper feed method which is to be used by the image forming device.

5. A method according to claim 4, further comprising the step of:

determining different fixing operation temperatures of the fixing device, which are to be used by the controlling step, based on which of the paper feed paths of the image forming apparatus is to be used and which paper feed method is to be used by the image forming device.

6. A fixing temperature control method for controlling a fixing temperature of a fixing device in an image forming apparatus which can use a plurality of paper feed methods which can handle different thicknesses of paper, comprising the steps of:

determining whether a first paper feed method for removing a page from a paper holder by bending the page in order to separate the page from the paper holder, or a second paper feed method for removing a page from a paper holder is to be used, the first paper feed method having a maximum paper thickness capability which is less than a maximum paper thickness capability of the second paper feed method; and controlling a fixing operation temperature of the fixing device based on whether the first or second paper feed method is to be used by the image forming apparatus.

7. A method according to claim 6, wherein the determining step comprises:

determining if the first paper feed method which is the corner nail method is to be used.

8. A method according to claim 7, wherein the determining step comprises:

determining if the second paper feed method which is the feed and reverse roller method is to be used.

9. A method according to claim 6, wherein the determining step comprises:

determining if the second paper feed method which is the feed and reverse roller method is to be used.

10. A method according to claim 6, further comprising the step of:

determining different fixing operation temperatures of the fixing device which are to be used by the controlling step based on the different paper feed methods.

11. An image forming device, comprising:

a plurality of paper feeders supplying paper along respective paper paths;

an image forming unit which forms a toner image on paper from the paper feeders;

a fixing device which fixes the toner image on the recording paper;

a memory which stores information used for controlling a fixing temperature of the fixing device; and means for determining which of the paper paths is to be used; and means for controlling a fixing operation temperature of the fixing device based on a size of an arc of the paper path which is to be used.

12. A device according to claim 11, wherein the means for controlling selects the fixing operation temperature from a plurality of temperatures which are used with the paper paths, at least two of which have different size non-zero arcs.

13. A device according to claim 11, further comprising:

means for determining a paper feed method which is to be used by the image forming device;

wherein the means for controlling further includes means for controlling the fixing operation temperature of the fixing device based on the paper feed method which is to be used by the image forming device.

14. An image forming device, comprising:

a plurality of paper feeders supplying paper along respective paper paths;

an image forming unit which forms a toner image on paper from the paper feeders;

a fixing device which fixes the toner image on the recording paper;

a memory which stores information used for controlling a fixing temperature of the fixing device; and means for determining whether a first paper feed method for removing a page from a first of the paper feeders by bending the page in order to separate the page from the first of the paper feeders, or a second paper feed method for removing a page from a second of the paper feeders is to be used, the first paper feed method having a maximum paper thickness capability which is less than a maximum paper thickness capability of the second paper feed method; and means for controlling a fixing operation temperature of the fixing device based on whether the first or second paper feed method is to be used by the image forming apparatus.

15. A device according to claim 14, wherein the means for determining comprises:

means for determining if the first paper feed method which is the corner nail method is to be used.

16. A device according to claim 14, wherein the means for determining comprises:

means for determining if the second paper feed method which is the feed and reverse roller method is to be used.

17. A device according to claim 15, wherein the means for determining comprises:

means for determining if the second paper feed method which is the feed and reverse roller method is to be used.

18. A fixing temperature control method for controlling a fixing temperature of a fixing device in an image forming apparatus which has a plurality of paper feed devices which have different paper feed paths, comprising:

means for generating information indicative of a paper feed path and information indicative of a form of paper feed on a selected paper feed device among said plurality of paper feed devices; and controlling said fixing temperature based on the generated paper feed path information and based on the generated form of paper feed information, wherein said paper feed device is selected by a size of an image to be formed and a magnification, and wherein if the same size paper is stored in the plural paper feed devices, the paper feed device of the lowest fixing temperature is selected.

19. A fixing temperature control method for controlling a fixing temperaure of a fixing device in an image forming apparatus which has a plurality of paper feed devices which have different paper feed paths, comprising:

generating information indicative of a paper feed path and information indicative of a form of paper feed on a selected paper feed device among said plurality of paper feed devices: and controlling said fixing temperature based on the generated paper feed path information and based on the generated form of paper feed information, wherein said paper feed path is a turned path, said fixing temperature is set in response to a size of an arc of said turned path.

* * * * *